US011349221B2

(12) United States Patent
Fu et al.

(10) Patent No.: US 11,349,221 B2
(45) Date of Patent: May 31, 2022

(54) DIELECTRIC STRUCTURE APPLIED TO BUILDING COMPONENTS FOR INCREASING TRANSMITTANCE OF RF SIGNAL AND DISPOSING METHOD THEREOF

(71) Applicant: Hsien-Chiung Fu, New Taipei (TW)

(72) Inventors: Hsien-Chiung Fu, New Taipei (TW); Ming Lu, New Taipei (TW); Yat Tung Ng, Siu Sai Wan (HK)

(73) Assignee: Hsien-Chiung Fu, New Taipei (TW)

( * ) Notice: Subject to any disclaimer, the term of this patent is extended or adjusted under 35 U.S.C. 154(b) by 56 days.

(21) Appl. No.: 17/093,956

(22) Filed: Nov. 10, 2020

(65) Prior Publication Data

US 2021/0151893 A1 May 20, 2021

Related U.S. Application Data

(60) Provisional application No. 62/935,921, filed on Nov. 15, 2019.

(51) Int. Cl.

| | |
|---|---|
| ***H01Q 15/00*** | (2006.01) |
| ***H01Q 1/38*** | (2006.01) |
| ***H01Q 1/42*** | (2006.01) |

(52) U.S. Cl.

CPC ..... *H01Q 15/0013* (2013.01); *H01Q 1/38* (2013.01); *H01Q 1/422* (2013.01)

(58) Field of Classification Search

CPC ..... H01Q 1/38; H01Q 15/00; H01Q 1/42
USPC ..... 343/700 R
See application file for complete search history.

(56) References Cited

U.S. PATENT DOCUMENTS

| | | | | |
|---|---|---|---|---|
| 4,125,841 | A | 11/1978 | Munk | |
| 6,661,386 | B1 | 12/2003 | Petros et al. | |
| 6,730,389 | B2 | 5/2004 | Voeltzel | |
| 7,091,915 | B1 * | 8/2006 | Truthan | H01Q 1/325 343/715 |
| 8,009,107 | B2 | 8/2011 | Li et al. | |
| 2018/0159241 | A1 * | 6/2018 | Niembro | C03C 17/23 |

FOREIGN PATENT DOCUMENTS

| | | | |
|---|---|---|---|
| CN | 104685578 | A | 6/2015 |
| EP | 1343221 | B1 | 9/2006 |
| JP | 2004053466 | A | 2/2004 |
| JP | 2011254482 | A | 12/2011 |

* cited by examiner

*Primary Examiner* — Andrea Lindgren Baltzell
(74) *Attorney, Agent, or Firm* — Snyder, Clark, Lesch & Chung, LLP

(57) ABSTRACT

A dielectric structure applied to building components for increasing a transmittance of an RF signal is provided. The dielectric structure includes a structural body and a fixing component. The structural body includes at least one dielectric material layer, and a dielectric constant of each dielectric material layer is between 1 and 10,000. The fixing component joins the structural body and a joining component. A composite structure after the dielectric structure and building components are joined may have the RF signal of the working frequency $f_0$ pass and reduce the reflection loss. The minimum equivalent diameter of a projection plane on a surface of the joining component of the dielectric structure on a surface through which an RF signal passes is no less than one-eighth of a working wavelength $\lambda_0$ corresponding to the working frequency $f_0$.

11 Claims, 9 Drawing Sheets

DIELECTRIC STRUCTURE APPLIED TO BUILDING COMPONENTS FOR INCREASING TRANSMITTANCE OF RF SIGNAL AND DISPOSING METHOD THEREOF

CROSS-REFERENCE TO RELATED APPLICATION

This application claims priority to and the benefit of, pursuant to 35 U.S.C. § 119, U.S. provisional patent application Ser. No. 62/935,921 filed on Nov. 15, 2019, the disclosure of which is incorporated herein in its entirety by reference.

BACKGROUND OF THE INVENTION

1. Field of the Invention

The present invention relates to a dielectric structure and disposing method thereof. The dielectric structure after being joined with dielectric building components may increase the transmittance of an RF signal of a specific spectrum on the dielectric building components.

2. Description of the Related Art

To meet the market demand for rapid information transmission, the communication industry has gradually adopted a high frequency electromagnetic wave for signal transmission. Since a frequency band is increased to a high frequency spectrum, the impact of building materials and building components on communication transmission is rather vital. Among several building materials, dielectric materials such as glass, cement, wood, ceramics, plastics, and the like, may be included in the scope. Even though some dielectric materials have lower dielectric loss parameters, extremely low dielectric loss to the passed electromagnetic wave may occur. However, in a specific electromagnetic spectrum, the reflection loss may still occur due to a mismatch between the dielectric constants of the material itself and the surrounding. Take a glass without any coating in the air as an example. A typical glass may generate a reflection loss of 2 to 4 dB under an environment of high frequency communication. That is, during the transmission, 50% of the energy of the electromagnetic wave may be converted into a reflection loss due to the shielding of the glass.

To solve the problem of attenuation generated when a signal passes through building materials or building components, several instances have been studied and may be categorized into several solutions, including inner antennas, inner and outer antennas with leads, dielectric antennas, periodic conductive structure, and the like therein. The solutions, such as disposing inner antennas, inner and outer antennas with leads, and the like, are widely applied to vehicle communication and building environments. For such solutions, signals are received through antennas. The received signals are amplified according to the system design thereof, or the signals are not amplified and are sent out via leads or antennas. The illustrative instances are patent applications, U.S. Pat. Nos. 6,661,386, 7,091,915, 8,009,107, and EP1343221. In the solution of dielectric antennas, a surface of a dielectric object is used as an antenna substrate, and a transmitting and receiving antenna is prepared through a patterned conductive layer. A related instance such as the patent application, CN104685578B. In the solution of a periodic metal structure, the periodic metal structure is manufactured on a dielectric body. By adjusting the size of the metal structure, the overall structure to an electromagnetic wave at a specific wavelength generates a selective transmittance. Such a periodic metal structure is also called a frequency selective surface. Related instances such as patent applications, JP2004053466, JP2011254482, U.S. Pat. Nos. 4,125,841, 6,730,389, and US2018/0159241. However, all the solutions as mentioned above require a conductive structure for transmitting and receiving electromagnetic signals or filtering.

SUMMARY OF THE INVENTION

According to the problems mentioned above, the technical subject of the present invention is to provide a device for increasing an electromagnetic wave transmittance of building components made of dielectric materials and disposing method thereof to solve the communication problem in the prior art. Since there is no need to manufacture a patterned conductive layer, and no power and signal contacts are required, it has the advantages of easy production, low cost, and simple installation.

According to one embodiment of the present invention, a dielectric structure applied to building components for increasing a transmittance of an RF signal is provided. The dielectric structure includes a structural body and a fixing component. The structural body includes at least one dielectric material layer. The fixing component joins the structural body and a joining component (building components), and a dielectric constant of the dielectric material layer is between 1 and 10,000. A composite structure after the fixing component joins the dielectric structure and building components may have the RF signal of the working frequency $f_0$ pass and reduce the reflection loss. The minimum equivalent diameter of a projection plane on a surface of the joining component of the dielectric structure on a surface through which an RF signal passes is no less than one-eighth of a working wavelength $\lambda_0$ corresponding to the working frequency $f_0$.

Preferably, the fixing component may further include a dielectric material layer, and a dielectric constant thereof is between 1 and 10,000.

Preferably, the fixing component may be located between the structural body and the joining component.

Preferably, the dielectric structure may further include a gap area.

Preferably, the gap area may be located between the structural body and the joining component.

Preferably, the gap area may be disposed inside the structural body without contacting the joining component.

According to another embodiment of the present invention, a disposing method of a dielectric structure is provided, and the dielectric structure is applied to building components for increasing transmittance of an RF signal. The method includes joining a structural body and a joining component by a fixing component, the structural body is formed by at least one dielectric material layer, and the fixing component is formed by a dielectric material layer in an area where an RF signal is set to pass. Based on an admittance compensation technique, a dielectric constant of the dielectric material layer of the structural body and the fixing component is between 1 and 10,000. A composite structure after the fixing component joins the dielectric structure and building components may have the RF signal of the working frequency $f_0$ pass and reduce the reflection loss. The minimum equivalent diameter of a projection plane on a surface of the joining component of the dielectric structure on a surface through which an RF signal passes is no less than one-eighth of a working wavelength $\lambda_0$ corresponding to the working frequency $f_0$.

Preferably, the method may further include disposing a gap area in the dielectric structure.

The dielectric structure and disposing method thereof according to the present inventive concept have the following advantages: (1) The present invention may be manufactured of a dielectric material, which has a simple structure and manufacturing process, thus being advantageous to mass production. (2) No external power or signal is required, thus making it convenient to install and use. (3) No electricity is required for operation, which may save electricity and operating costs. (4) The dielectric structure is not a signal emission source, so there is no hidden danger of biological safety due to electromagnetic radiation.

DESCRIPTION OF THE PREFERRED EMBODIMENTS

To facilitate the review of the technical features, contents, advantages, and achievable effects of the present invention, the embodiments together with the accompanying drawings are described in detail as follows. However, the drawings are used only for the purpose of indicating and supporting the specification, which is not necessarily the real proportion and precise configuration after the implementation of the present invention. Therefore, the relations of the proportion and configuration of the accompanying drawings should not be interpreted to limit the actual scope of implementation of the present invention.

Figure 1:
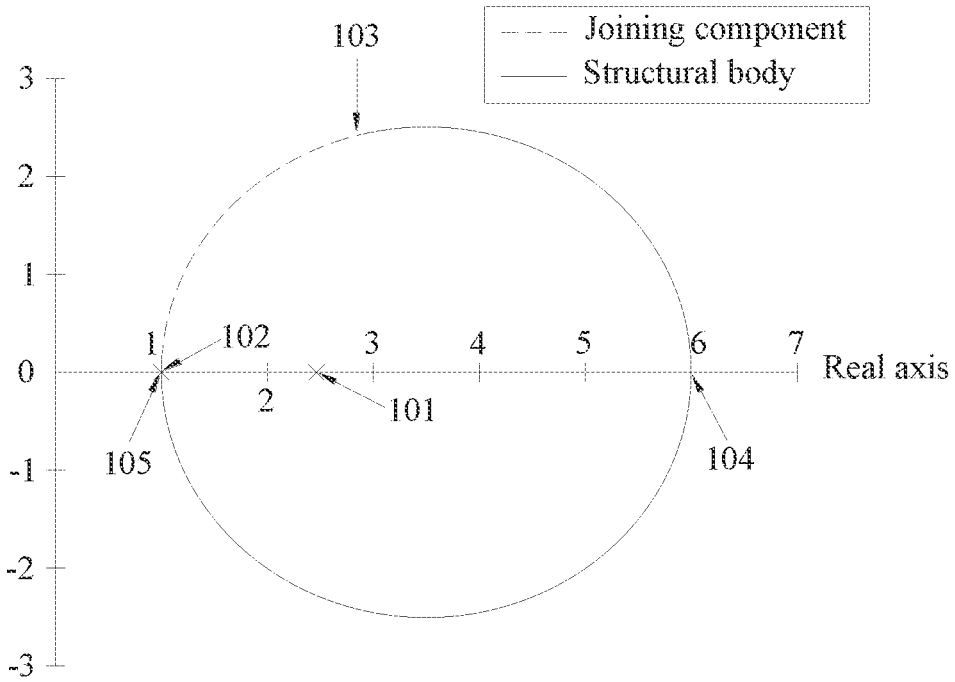
FIG. 1 illustrates an admittance chart according to the prior art.

Please refer to FIG. 1, which illustrates an admittance chart according to the prior art. Take a joining component (shown by position 101) of $\varepsilon_s=\varepsilon_r=6$ being placed in an environment (shown by position 102) of $\varepsilon_r=1$ as an example. As the thickness of the joining component gradually increases from 0 to $t_s$, the admittance value $\alpha_s$ moves from position 102 to position 103 in a clockwise direction. Next, the structural body formed by the first dielectric material with a dielectric coefficient of $\varepsilon_1=\varepsilon_r=6$ is selected to bond the aforementioned joining component to form a composite structure. As the thickness of the device gradually increases from 0 to $t_1$, after passing position 104 of the phase thickness $$(2*n-1)*\frac{\pi}{2}$$

of the real axis from position 103 shown in the drawing, the admittance value $\alpha_s+\alpha_1$ of the composite structure further intersects with position 105 of the phase thickness $n*\pi$ of the real axis. Hence, $t_1$ corresponding to the phase thickness $n*\pi$ is the optimal thickness of the device, so that the composite structure has increased transmittance in a specific electromagnetic spectrum. Wherein, the n value in the aforementioned two equations is a non-zero positive integer. For a multi-layer structure or a fixing component as a dielectric located in an area where an RF signal is set to pass, the compensation analysis method thereof is the same as that as mentioned above. In addition, in consideration of bandwidth and a manufacturing process in a practical application, +1-25% is considered to be an acceptable thickness variation range.

The thickness of the device is determined based on the admittance compensation technique shown in FIG. 1. Next, please refer to FIGS. 2A to 2D, which respectively illustrate cross-sectional views of the dielectric structure according to different embodiments of the present invention.

Figure 2A:
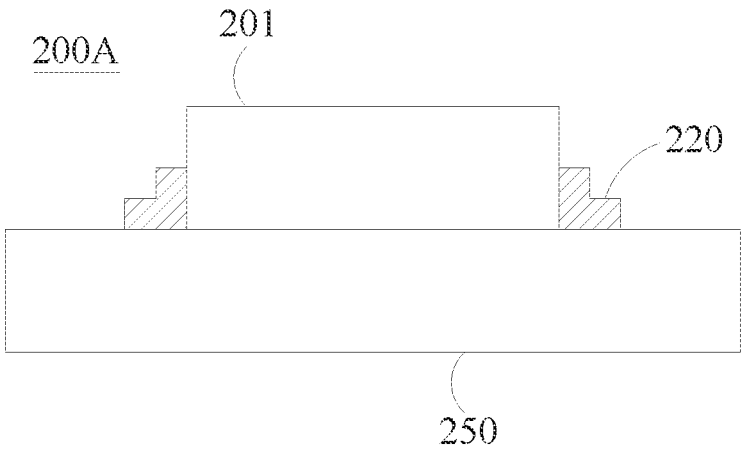
FIGS. 2A to 2D respectively illustrate cross-sectional views of the dielectric structure according to an embodiment of the present invention.

Wherein, the dielectric structure 200A shown in FIG. 2A includes a structural body formed by at least one first dielectric material layer 201 and a fixing component 220. The fixing component 220 is used to bond the structural body and the joining component 250. For a composite structure after the dielectric structure 200A and the joining component 250 are joined, under the RF signal transmission state with the working frequency of $f_0$ and the corresponding wavelength of $\lambda_0$, the dielectric constant of the first dielectric material layer 201 ranges from 1 to 10,000. The minimum equivalent diameter of a projection plane on a surface of the joining component of the dielectric structure 200A on a surface through which an RF signal passes is no less than $\lambda_0/8$.

Figure 2B:
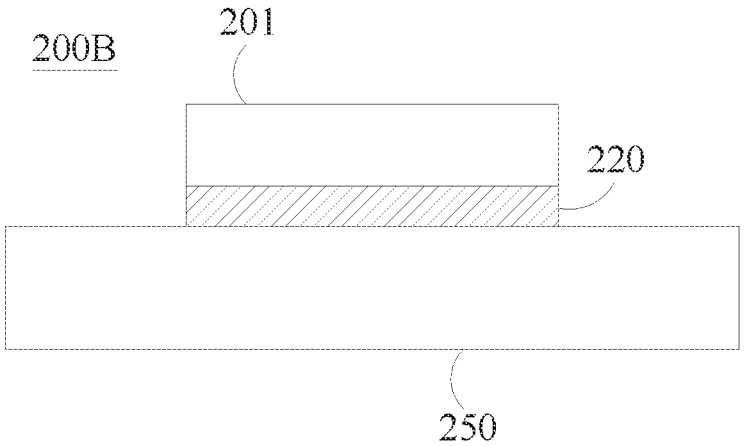

According to another embodiment of the present invention, the dielectric structure 200B shown in FIG. 2B includes a structural body formed by at least one first dielectric material layer 201 and a fixing component 220 formed by a second dielectric material layer. The fixing component 220 is used to join the dielectric structure and the joining component 250. For a composite structure after the dielectric structure 200B and the joining component 250 are joined, under the RF signal transmission state with the working frequency of $f_0$ and the corresponding wavelength of $\lambda_0$, the dielectric constant of the first dielectric material layer ranges from 1 to 10,000, and the dielectric constant of the second dielectric material layer ranges from 1 to 10,000. The minimum equivalent diameter of a projection plane on a surface of the joining component of the dielectric structure 200B on a surface through which an RF signal passes is no less than $\lambda_0/8$. The dielectric structure 200B differs from the dielectric structure 200A in that the fixing component 220 is located between the structural body and the joining component 250.

Figure 2C:
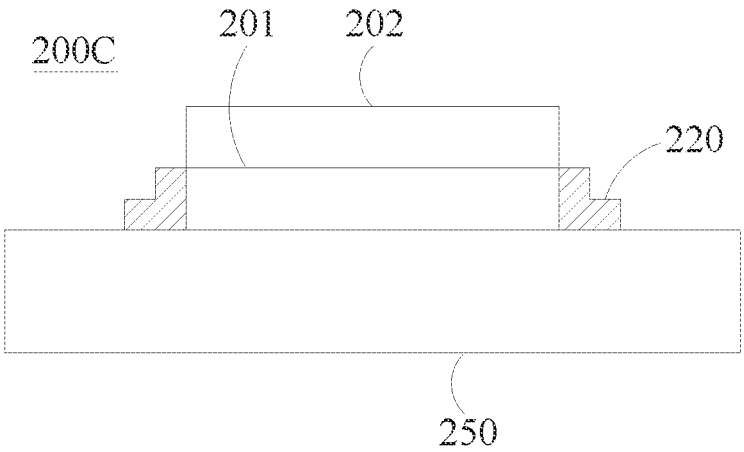

According to another embodiment of the present invention, the dielectric structure 200C shown in FIG. 2C includes a structural body formed by at least one first dielectric material layer 201 and a second dielectric material layer 202, and a fixing component 220. The fixing component 220 is used to join the structural body and the joining component 250. The second dielectric material layer 202 may partially cover the first dielectric material layer 201. For a composite structure after the dielectric structure 200C and the joining component 250 are joined, under the RF signal transmission state with the working frequency of $f_0$ and the corresponding wavelength of $\lambda_0$, the dielectric constants of both the first dielectric material layer 201 and the second dielectric material layer 202 range from 1 to 10,000. The minimum equivalent diameter of a projection plane on a surface of the joining component of the dielectric structure 200C on a surface through which an RF signal passes is no less than $\lambda_0/8$.

Figure 2D:
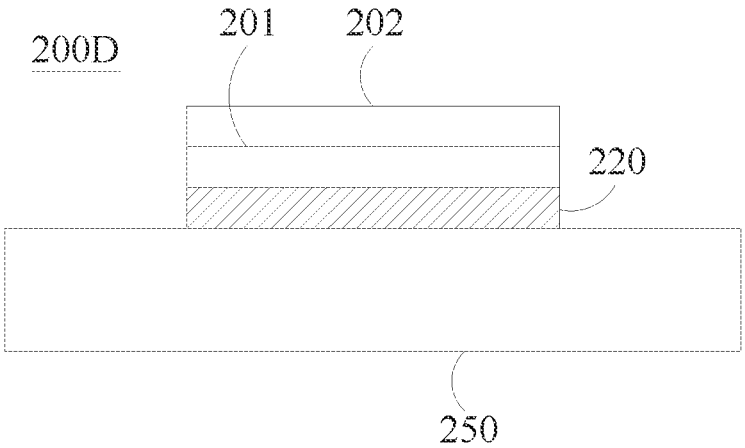

According to another embodiment of the present invention, the dielectric structure 200D shown in FIG. 2D includes a structural body formed by at least one first dielectric material layer 201 and a second dielectric material layer 202, and a fixing component 220 formed by a third dielectric material layer. The fixing component 220 is used to join the structural body and the joining component 250. The second dielectric material layer may partially cover the first dielectric material layer. For a composite structure after the dielectric structure 200D and the joining component 250 are joined, under the RF signal transmission state with the working frequency of $f_0$ and the corresponding wavelength of $\lambda_0$, the dielectric constants of the first dielectric material layer 201, the second dielectric material layer 202, and the fixing component 220 formed by the third dielectric material layer range from 1 to 10,000. The minimum equivalent diameter of a projection plane on a surface of the joining component of the dielectric structure 200D on a surface through which an RF signal passes is no less than $\lambda_0/8$.

Next, please refer to FIGS. 3A to 3D, which respectively illustrate cross-sectional views of the dielectric structure according to an embodiment of the present invention. Different from the embodiment shown in FIGS. 2A to 2D, the dielectric structure of the embodiment shown in FIGS. 3A to 3D includes a gap area.

Figure 3A:
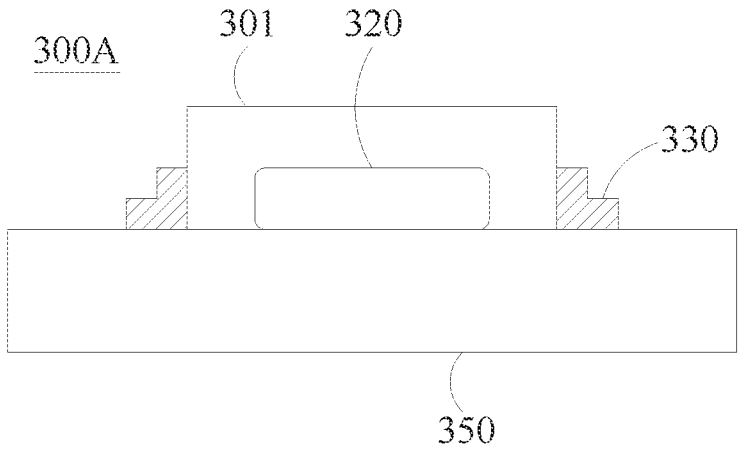
FIGS. 3A to 3D respectively illustrate cross-sectional views of the dielectric structure according to an embodiment of the present invention.

Wherein, the dielectric structure 300A in FIG. 3A includes a structural body formed by at least one first dielectric material layer 301, a gap area 320, and a fixing component 330. The fixing component 330 is used to bond the structural body and the joining component 350. For a composite structure after the dielectric structure 300A and the joining component 350 are joined, under the RF signal transmission state with the working frequency of $f_0$ and the corresponding wavelength of $\lambda_0$, the dielectric constant of the first dielectric material layer 301 ranges from 1 to 10,000. The minimum equivalent diameter of a projection plane on a surface of the joining component of the dielectric structure 300A on a surface through which an RF signal passes is no less than $\lambda_0/8$.

Figure 3B:
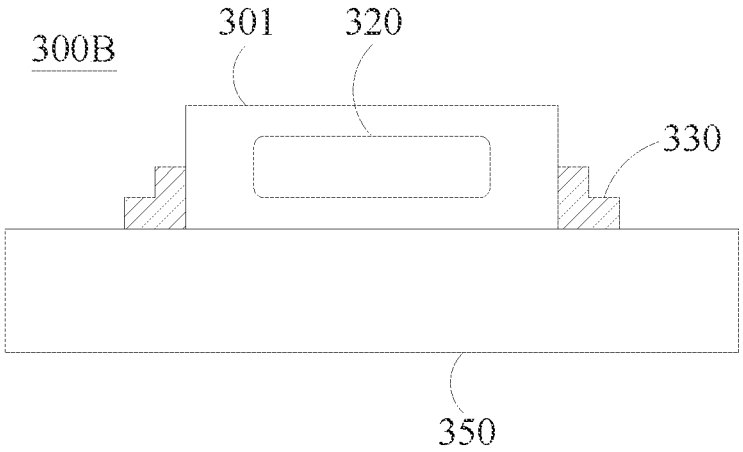

According to another embodiment of the present invention, the dielectric structure 300B in FIG. 3B includes a structural body formed by at least one first dielectric material layer 301, a gap area 320, and a fixing component 330. The fixing component 330 is used to bond the structural body and the joining component 350. For a composite structure after the dielectric structure 300B and the joining component 350 are joined, under the RF signal transmission state with the working frequency of $f_0$ and the corresponding wavelength of $\lambda_0$, the dielectric constant of the first dielectric material layer 301 ranges from 1 to 10,000. The minimum equivalent diameter of a projection plane on a surface of the joining component of the dielectric structure 300B on a surface through which an RF signal passes is no less than $\lambda_0/8$.

Figure 3C:
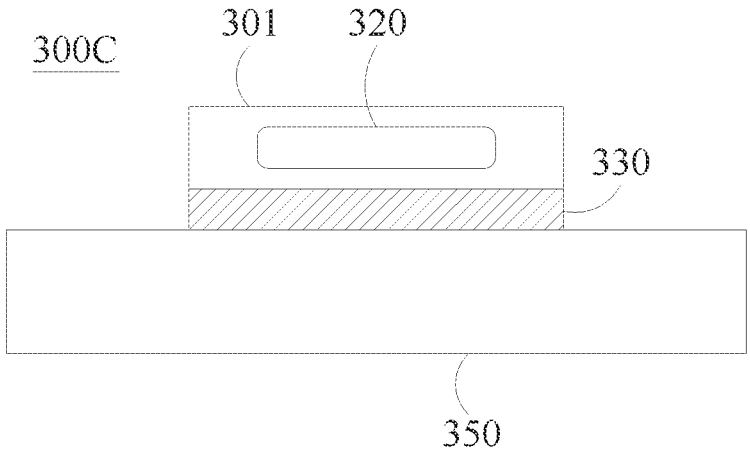

According to another embodiment of the present invention, the dielectric structure 300C shown in FIG. 3C includes a structural body formed by at least one first dielectric material layer 301, a gap area 320, and a fixing component 330 formed by a second dielectric material layer. The fixing component 330 may be a second dielectric material having a dielectric constant within a range from 1 to 10,000, fill at least one part of a gap between the structural body and the joining component 350, and join the structural body and the joining component 350. For a composite structure after the dielectric structure 300C and the joining component 350 are joined, under the RF signal transmission state with the working frequency of $f_0$ and the corresponding wavelength of $\lambda_0$, the dielectric constant of the first dielectric material layer 301 ranges from 1 to 10,000. The minimum equivalent diameter of a projection plane on a surface of the joining component of the dielectric structure 300C on a surface through which an RF signal passes is no less than $\lambda_0/8$.

Figure 3D:
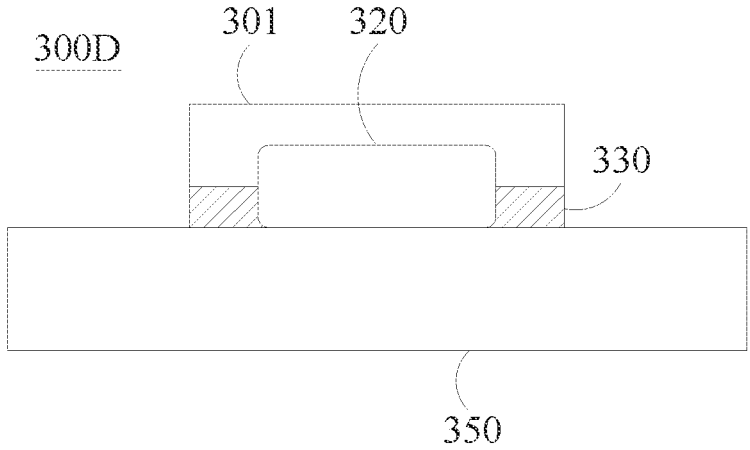

According to another embodiment of the present invention, the dielectric structure 300D shown in FIG. 3D includes a structural body formed by at least one first dielectric material layer 301, a gap area 320, and a fixing component 330 formed by a second dielectric material layer. The fixing component 330 may be a second dielectric material having a dielectric constant within a range from 1 to 10,000, fill at least one part of a gap between the structural body and the joining component 350, and join the structural body and the joining component 350. For a composite structure after the dielectric structure 300D and the joining component 350 are joined, under the RF signal transmission state with the working frequency of $f_0$ and the corresponding wavelength of $\lambda_0$, the dielectric constant of the first dielectric material layer 301 ranges from 1 to 10,000. The minimum equivalent diameter of a projection plane on a surface of the joining component of the dielectric structure 300D on a surface through which an RF signal passes is no less than $\lambda_0/8$.

Figure 4:
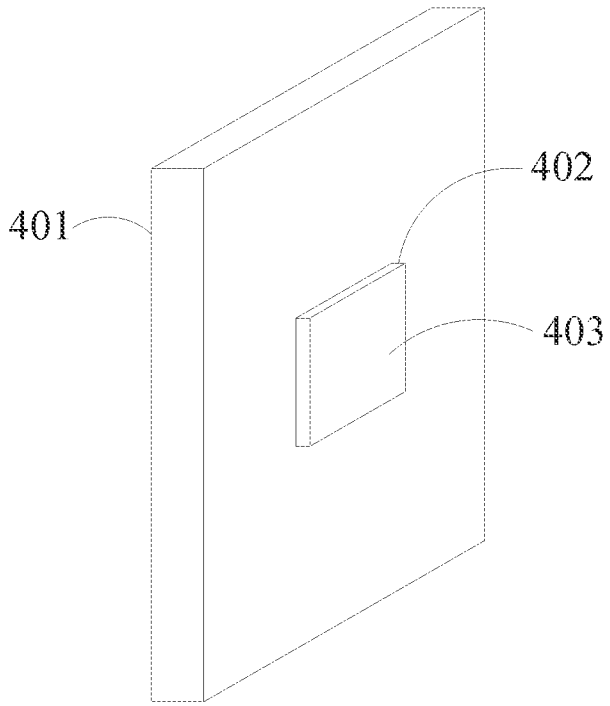
FIG. 4 illustrates a schematic diagram of the use of joining the dielectric structure and the joining component according to an embodiment of the present invention.

Please refer to FIG. 4, which illustrates a schematic diagram of the joining state of joining the joining component 401 to the structural body 403 through the fixing component 402 according to an embodiment of the present invention. The aforementioned joining component 401 may be building components such as glass, cement, wood, ceramic, plastic, and other dielectric materials. However, the present invention is not limited thereto. The joining component may be any component that requires enhancing the transmittance of RF signals thereon.

In addition, since the dielectric constant changes according to the working frequency, types of specific materials need to be correspondingly adjusted depending on the dielectric constant of the joining component in a working spectrum. The following are representative materials that may be used but not limited thereto. The materials include low dielectric constant materials: PTFE, PE, PC, PVC, Acrylic, PU, Epoxy, Silicone, and the like; medium dielectric constant materials: quartz, glass, aluminum oxide crystals and ceramics, aluminum nitride crystals and ceramics, magnesium oxide crystals and ceramics, silicon carbide crystals and ceramics, zirconia crystals and ceramics, and the like; high dielectric constant materials: titanium oxide crystals and ceramics, barium titanate polymer composites, and the like.

Figure 5A:
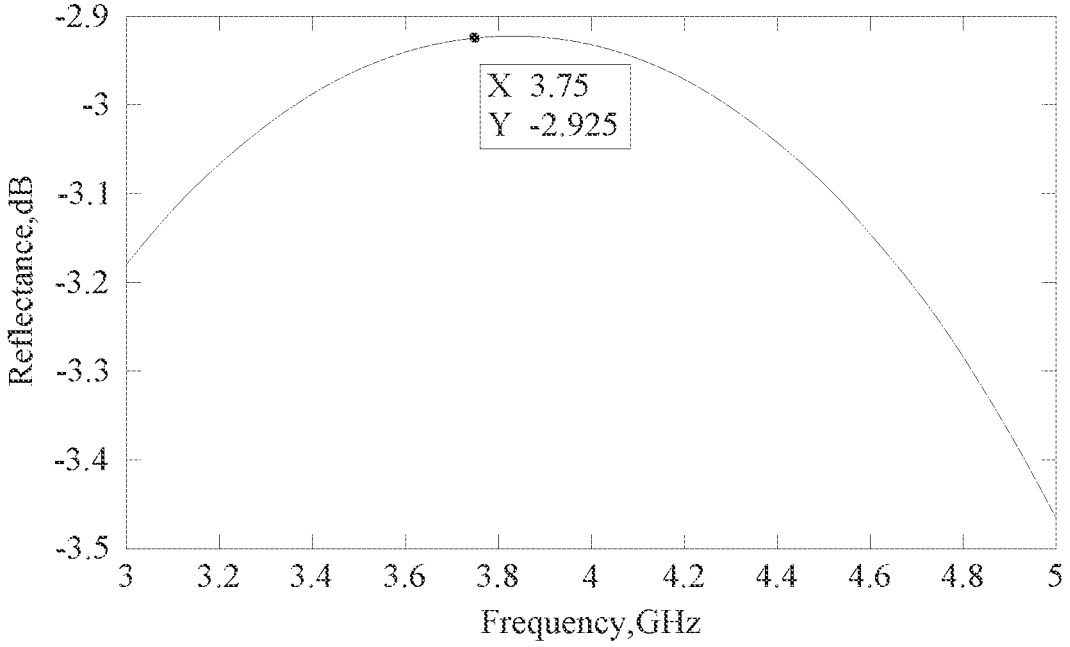
FIGS. 5A and 5B respectively illustrate curve diagrams of reflectance and transmittance of 3 GHz to 5 GHz electromagnetic waves penetrating a glass with a thickness of 8 mm and a dielectric constant of 6.
Figure 5B:
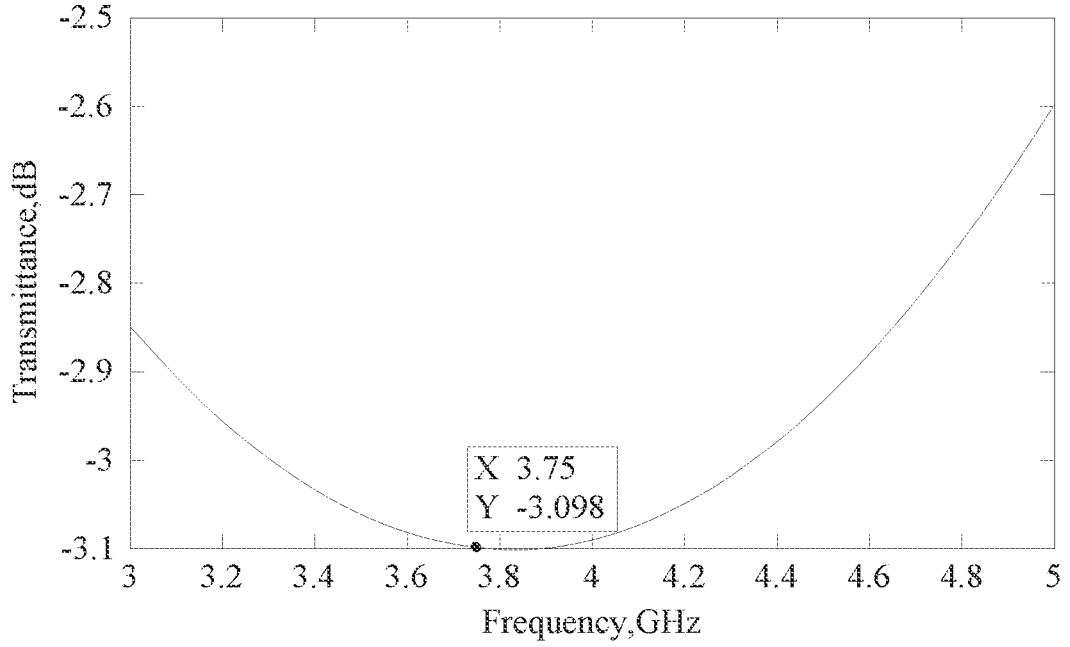

Please refer to FIG. 5A and FIG. 5B, which respectively illustrate curve diagrams of reflectance and transmittance of 3 GHz to 5 GHz electromagnetic waves penetrating a glass with a thickness of 8 mm and a dielectric constant of 6. As shown, the reflectance at the working frequency of 3.75 GHz is −2.925 dB, and the transmittance is decreased to −3.098 dB due to the effect of reflection.

Figure 6A:
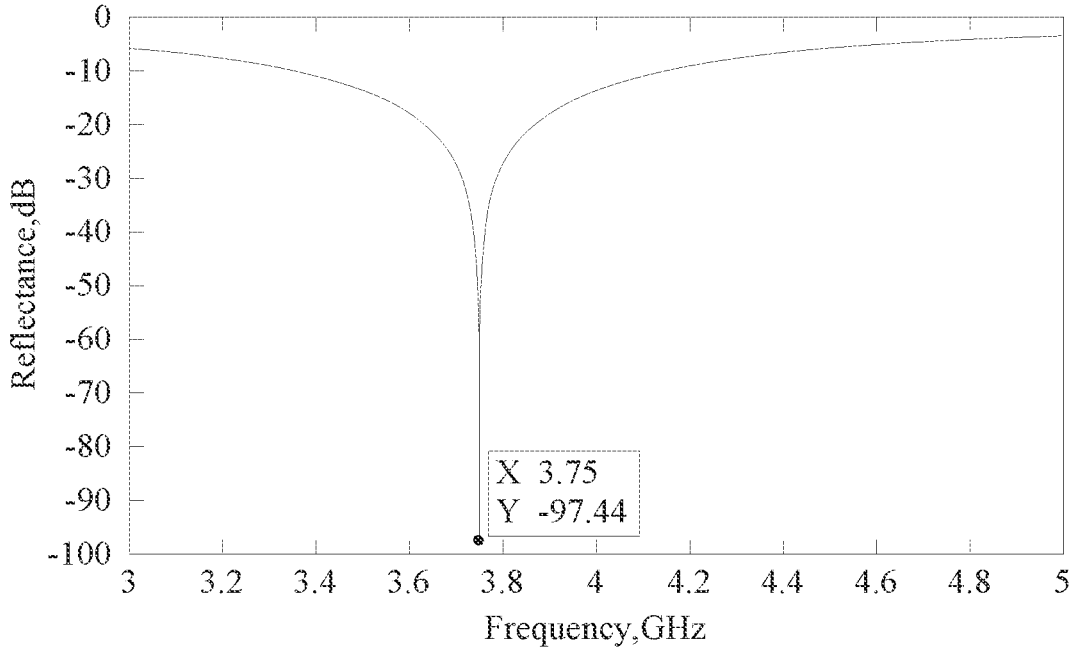
FIGS. 6A and 6B respectively illustrate curve diagrams of reflectance and transmittance of 3 GHz to 5 GHz electromagnetic waves penetrating a glass with a thickness of 8 mm and a dielectric constant of 6 with a dielectric structure bonded thereon according to one embodiment of the present invention.
Figure 6B:
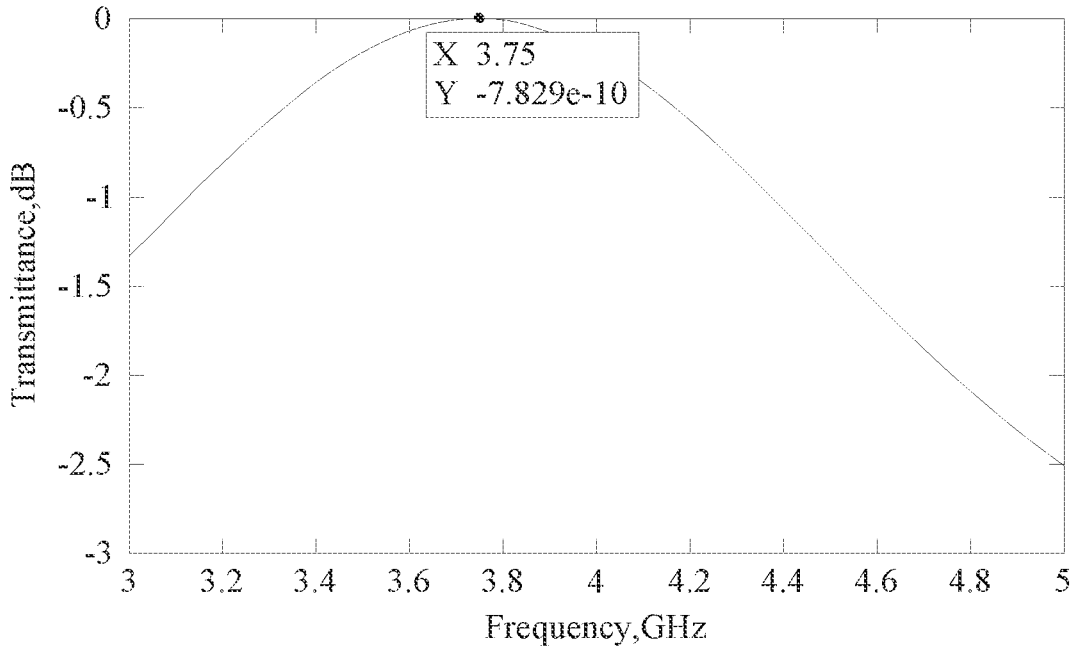

Please refer to FIG. 6A and FIG. 6B, which illustrate curve diagrams of reflectance and transmittance of 3 GHz to 5 GHz electromagnetic waves penetrating a glass with a thickness of 8 mm and a dielectric constant of 6 with a dielectric structure bonded thereon as shown in FIG. 2A. Wherein, the thickness of the dielectric structure is 8.33 mm, and the dielectric constant thereof is 6. Through simulation, at the working frequency of 3.75 GHz, the reflectance is decreased to −97.44 dB and the transmittance is −7.829e-10 dB. The result shows a significant increase in transmittance.

Figure 7A:
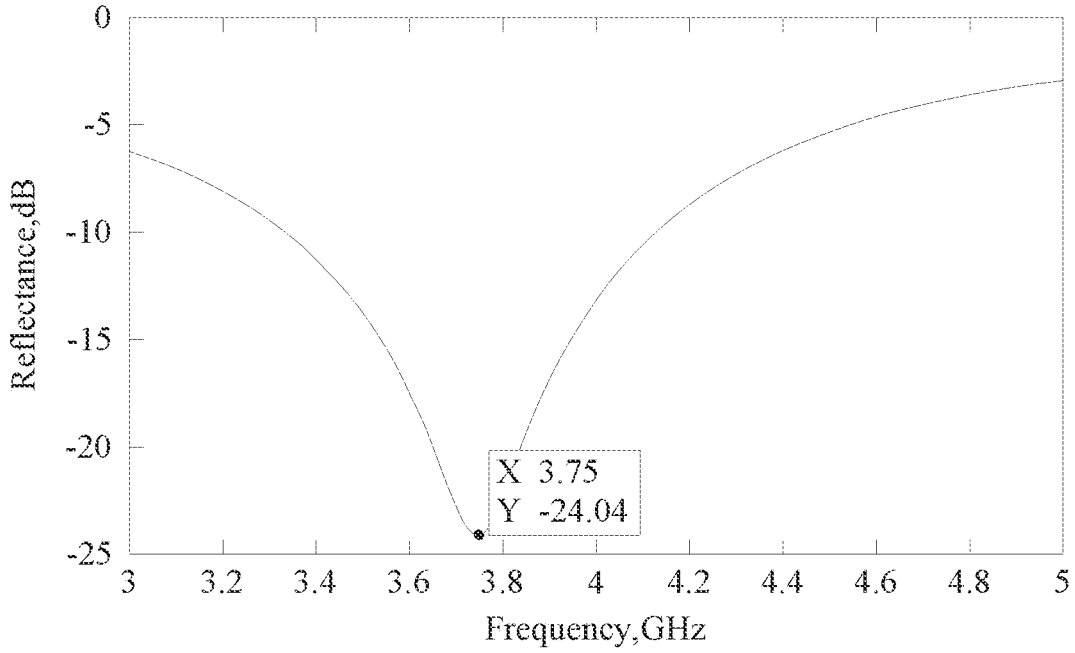
FIGS. 7A and 7B respectively illustrate curve diagrams of reflectance and transmittance of 3 GHz to 5 GHz electromagnetic waves penetrating a glass with a thickness of 8 mm and a dielectric constant of 6 with a dielectric structure bonded thereon according to one embodiment of the present invention.
Figure 7B:
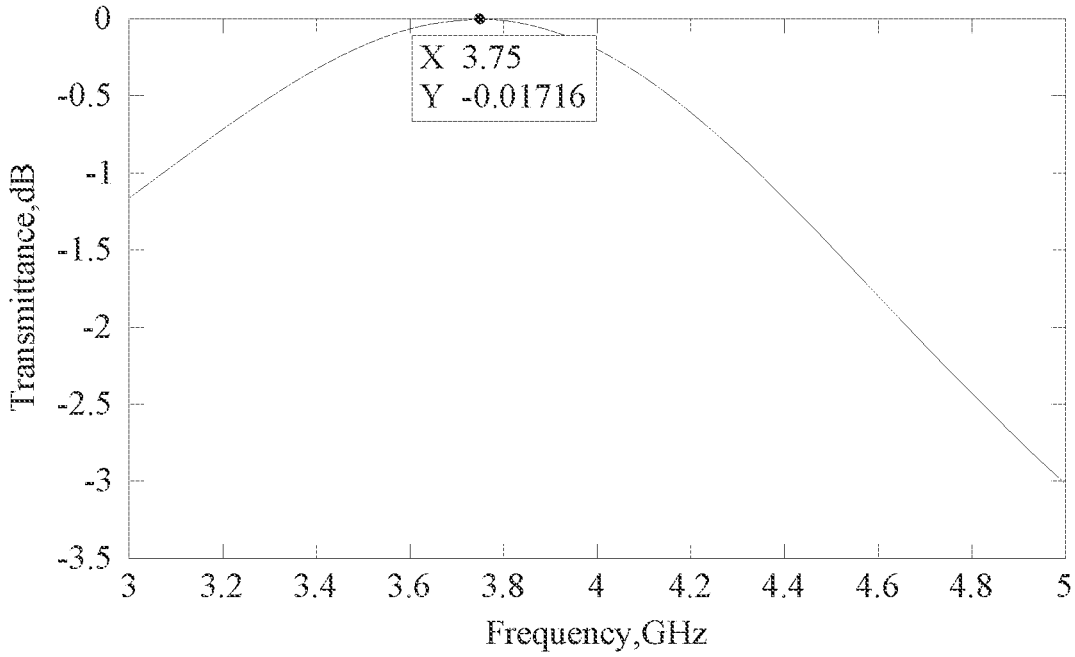

Please refer to FIG. 7A and FIG. 7B, which illustrate curve diagrams of reflectance and transmittance of 3 GHz to 5 GHz electromagnetic waves penetrating a glass with a thickness of 8 mm and a dielectric constant of 6 with a dielectric structure bonded thereon as shown in FIG. 3A. Wherein, the thickness of the dielectric structure is 6 mm, and the dielectric constant thereof is 6; the thickness of the gap area is 2.1 mm, and the medium therein is air. Through simulation, at the working frequency of 3.75 GHz, the reflectance is −24.04 dB and the transmittance is −0.01716 dB. The result shows a significant increase in transmittance.

The structure formed by the dielectric material may be analyzed for the admittance in the working spectrum. The composite structure generated by joining the dielectric structure and building components disclosed in the present invention may be used to adjust the admittance value, thus increasing the transmittance of working spectrum signals to the composite structural body.

The above description is merely illustrative rather than restrictive. Any equivalent modifications or alterations without departing from the spirit and scope of the present invention are intended to be included in the following claims.

What is claimed is:

1. A dielectric structure applied to building components for increasing a transmittance of an RF signal, the dielectric structure comprising:

a structural body comprising at least one dielectric material layer; and a fixing component disposed to join the structural body and a joining component;

wherein a dielectric constant of the dielectric material layer comprised in the structural body is between 1 and 10,000, a composite structure after the fixing component joins the dielectric structure and the joining component has a working frequency, and the minimum equivalent diameter of a projection plane on a surface of the joining component of the dielectric structure on a surface through which an RF signal passes is no less than one-eighth of a working wavelength corresponding to the working frequency.

2. The dielectric structure according to claim 1, wherein the fixing component further comprises a dielectric material layer, and a dielectric constant of the dielectric material layer of the fixing component is between 1 and 10,000.

3. The dielectric structure according to claim 2, wherein the fixing component is located between the structural body and the joining component.

4. The dielectric structure according to claim 2, further comprising a gap area.

5. The dielectric structure according to claim 3, further comprising a gap area.

6. The dielectric structure according to claim 4, wherein the gap area is located between the structural body and the joining component.

7. The dielectric structure according to claim 4, wherein the gap area is disposed inside the structural body without contacting the joining component.

8. The dielectric structure according to claim 5, wherein the gap area is located between the structural body and the joining component.

9. The dielectric structure according to claim 5, wherein the gap area is disposed inside the structural body without contacting the joining component.

10. A disposing method of a dielectric structure, the dielectric structure applied to building components for increasing a transmittance of an RF signal, the method comprising:

joining a structural body and a joining component by a fixing component;

wherein the structural body is formed by at least one dielectric material layer, and the fixing component is formed by a dielectric material layer in an area where an RF signal is set to pass; based on an admittance compensation technique, a dielectric constant of the dielectric material layer of the structural body and the fixing component is between 1 and 10,000; a composite structure after the fixing component joins the dielectric structure and the joining component has a working frequency, and the minimum equivalent diameter of a projection plane on a surface of the joining component of the dielectric structure on a surface through which an RF signal passes is no less than one-eighth of a working wavelength corresponding to the working frequency.

11. The disposing method according to claim 10, further comprising disposing a gap area in the dielectric structure.

* * * * *